US005510227A

United States Patent [19]

DoMinh et al.

[11] Patent Number: 5,510,227

[45] Date of Patent: Apr. 23, 1996

[54] IMAGE DYE FOR LASER ABLATIVE RECORDING PROCESS

[75] Inventors: Thap DoMinh, Fort Collins, Colo.; Linda Kaszczuk; Lee W. Tutt, both of Webster, N.Y.

[73] Assignee: Eastman Kodak Company, Rochester, N.Y.

[21] Appl. No.: 259,588

[22] Filed: Jun. 14, 1994

[51] Int. Cl.[6] ..... G03C 5/00

[52] U.S. Cl. ..... 430/269; 430/945; 430/964; 430/332; 430/346; 430/944

[58] Field of Search ..... 430/269, 270, 430/346, 945, 5, 964, 944, 201, 332, 338

[56] References Cited

U.S. PATENT DOCUMENTS 5,171,650 12/1992 Ellis et al. ..... 430/20
5,330,876 7/1994 Kaszczuk et al. ..... 430/269

*Primary Examiner*—Charles L. Bowers, Jr.
*Assistant Examiner*—John A. McPherson
*Attorney, Agent, or Firm*—Harold E. Cole

[57] ABSTRACT

A laser dye-ablative recording element comprising a support having thereon a dye layer comprising a yellow dye dispersed in a polymeric binder, the dye layer having an infrared-absorbing material associated therewith, the yellow dye comprising curcumin.

4 Claims, No Drawings

IMAGE DYE FOR LASER ABLATIVE RECORDING PROCESS

This invention relates to use of a certain image dye in a single-sheet laser dye-ablative recording element.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off the image dye at the spot where the laser beam hits the element and leaves the binder behind. In ablative imaging, the laser radiation causes rapid local changes in the imaging layer thereby causing the material to be ejected from the layer. This is distinguishable from other material transfer techniques in that some sort of chemical change (e.g., bond-breaking), rather than a completely physical change (e.g., melting, evaporation or sublimation), causes an almost complete transfer of the image dye rather than a partial transfer. Usefulness of such an ablative element is largely determined by the efficiency at which the imaging dye can be removed on laser exposure. The transmission Dmin value is a quantitative measure of dye clean-out: the lower its value at the recording spot, the more complete is the attained dye removal.

In U.S. Ser. No. 099,968 of Kaszczuk et al., filed Jul. 30, 1993, now U.S. Pat. No. 5,330,876, a single-sheet laser dye-ablative recording element is described in the Examples which employs a certain yellow dye. As will be shown by comparative tests hereinafter, the yellow dye employed in accordance with this invention has several improved properties thereover.

It is an object of this invention to provide a yellow dye which is ablatable, inexpensive, readily soluble in a variety of solvents, has an improved Dmin, has a high extinction coefficient for absorption, and which leaves only minute amounts of colored residues on ablation. Another object of the invention is the generation of a harmless, easily detected product to indicate the presence of uncollected post-ablative material. It is another object of this invention to provide a single-sheet process which does not require a separate receiving element.

These and other objects are achieved in accordance with the invention which comprises a laser dye-ablative recording element comprising a support having thereon a dye layer comprising a yellow dye dispersed in a polymeric binder, the dye layer having an infrared-absorbing material associated therewith, and the yellow dye comprising curcumin.

The yellow dye curcumin, also known as Brilliant Yellow S, is a natural product dye found in the spice turmeric. It has long been used in the making of curry and is therefore generally regarded as being safe. The structure is large for a molecule intended to be ablated, but surprisingly it was found to be readily decomposed to colorless products when subjected to a laser beam and thereby allowing one to achieve very good dye clean-out at modest laser powers.

It has also been found that, upon decomposition through laser-ablative imaging, the compound vanillin is produced. Vanillin is the active compound in vanilla which gives rise to the odor of vanilla. Therefore, the presence of even extremely small quantities of this compound is readily detected.

The dye curcumin is believed to be 1,7-bis(4 -hydroxy-3-methoxyphenyl)-1,6-heptadiene-3,5-dione. While isomers of this compound are believed to exist in the natural compound, the formula is believed to have the following structure:

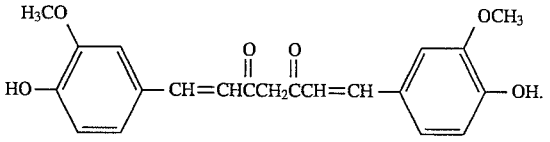

The dye ablation elements of this invention can be used to obtain medical images, reprographic masks, printing masks, etc. The image obtained can be a positive or a negative image. The reduction in Dmin obtained with this invention is important for graphic arts applications where the Dmin/Dmax of the mask controls the exposure latitude for subsequent use. This also improves the neutrality of the Dmin for medical imaging applications. The dye removal process can be by either continuous (photographic-like) or halftone imaging methods.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high UV Dmax. If it does not do this, the printing plate would not be developable to give regions which take up ink and regions which do not.

Any polymeric material may be used as the binder in the recording element employed in the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); polystyrene; poly(styrene-co-acrylonitrile); a polysulfone; a poly(phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The binder may be used at a coverage of from about 0.1 to about 5 $g/m^2$.

In a preferred embodiment, the polymeric binder used in the recording element employed in the process of the invention has a polystyrene equivalent molecular weight of at least 100,000 as measured by size exclusion chromatography, as described in copending U.S. Ser. No. 099,968, filed Jul. 30, 1993, now U.S. Pat. No. 5,330,876 and entitled, "HIGH MOLECULAR WEIGHT BINDERS FOR LASER ABLATIVE IMAGING", the disclosure of which is hereby incorporated by reference.

A barrier layer may be employed in the laser ablative recording element of the invention if desired, as described in copending U.S. Ser. No. 099,970, filed Jul. 30, 1993, now abandoned, and entitled BARRIER LAYER FOR LASER ABLATIVE IMAGING, the disclosure of which is hereby incorporated by reference.

To obtain a laser-induced, dye ablative image according to the invention, a diode laser is preferably employed since it offers substantial advantages in terms of its small size, low cost, stability, reliability, ruggedness, and ease of modulation. In practice, before any laser can be used to heat a dye-ablative recording element, the element must contain an infrared-absorbing material, such as cyanine infrared-absorbing dyes as described in U.S. Ser. No. 099,969, filed Jul. 30, 1993, now abandoned and entitled, "INFRARED-ABSORBING CYANINE DYES FOR LASER ABLATIVE IMAGING" or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing dye may be contained in the dye layer itself or in a separate layer associated therewith, i.e., above or below the dye layer. Preferably, the laser exposure in the process of the invention takes place through the dye side of the dye ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

The curcumin dye in the recording element of the invention may be used at a coverage of from about 0.01 to about 1 $g/m^2$.

The dye layer of the dye-ablative recording element of the invention may be coated on the support or printed thereon by a printing technique such as a gravure process.

Any material can be used as the support for the dye-ablative recording element of the invention provided it is dimensionally stable and can withstand the heat of the laser. Such materials include polyesters such as poly(ethylene naphthalate); poly(ethylene terephthalate); polyamides; polycarbonates; cellulose esters such as cellulose acetate; fluorine polymers such as poly(vinylidene fluoride) or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. In a preferred embodiment, the support is transparent.

The following examples are provided to illustrate the invention.

EXAMPLE 1

The following materials are employed below:

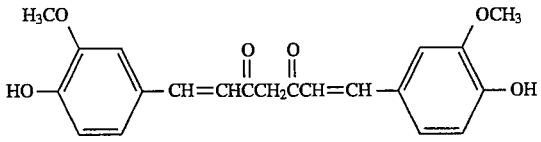

Curcumin
(yellow dye)

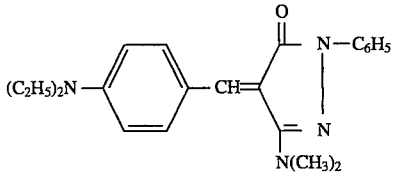

Yellow Dye Y-1
(Control)

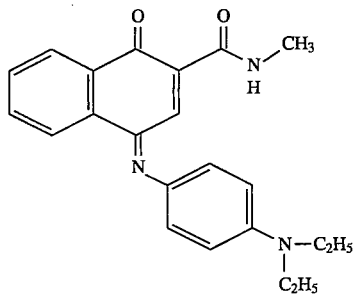

Cyan Dye C-1

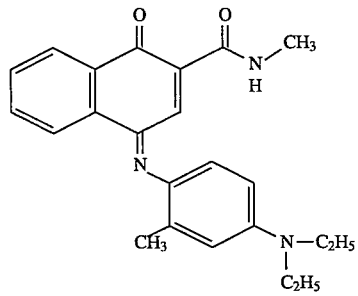

Cyan Dye C-2

-continued

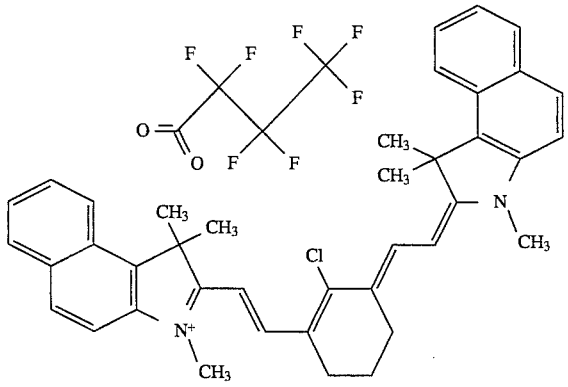

IR-Absorbing Dye IR-1

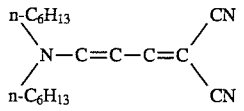

Liquid UV-Absorbing Dye UV-1

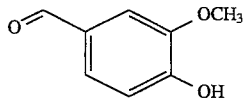

Vanillin (decomposition product of Curcumin)

Monocolor media sheets were prepared by coating 100 μm bare poly(ethylene terephthalate) support with 0.47 g/m$^2$ of 100 s. cellulose nitrate (Aqualon Co.), 0.24 g/m$^2$ IR-1 and 0.65 g/m$^2$ of yellow dye (Y-1 and curcumin, respectively). Light filtration was measured by an X-Rite Densitometer (Model 3-0T for Visible and Model 361T for UV, X-Rite Corp.) Table 1 shows the absorption densities obtained.

TABLE 1

| | UV Dmax | Red Dmax | Green Dmax | Blue Dmax |
|---|---|---|---|---|
| Y-1 | 0.7 | 0.14 | 0.44 | 6.1 |
| Curcumin | 3.2 | 0.14 | 0.24 | 6.6 |

As can be seen from the data in Table 1, the Blue Dmax is 8% higher and the UV Dmax is 360% higher for curcumin relative to yellow dye Y-1 at equal laydowns. This allows less dye to be used for similar filtrations.

EXAMPLE 2

Monocolor media sheets were prepared by coating 100 μm bare poly(ethylene terephthalate) support with 0.22 g/m$^2$ of 1000 s. cellulose nitrate (Aqualon Co.), 0.11 g/m$^2$ UV-1, 0.09 g/m$^2$ C-1, 0.04 g/m$^2$ C-2, 0.11 g/m$^2$ IR-1 and the quantity of yellow dye indicated in Table 2.

The samples were ablation-written using Spectra Diode Labs Laser Model SDL-2432, having integral, attached fiber for the output of the laser beam with a wavelength range of 800–830 nm and a nominal power output of 250 mW. at the end of the optical fiber. The cleaved face of the optical fiber was imaged onto the plane of the dye ablative element with a 0.5 magnification lens assembly mounted on a translation stage giving a nominal spot size of 25 μm.

The drum, 53 cm in circumference, was rotated at varying speeds and the imaging electronics were activated to provide the exposures given in Table 2. The translation stage was incrementally advanced across the dye ablation element by means of a lead screw turned by a microstepping motor, to give a center-to-center line distance of 10 μm (945 lines per centimeter, or 2400 lines per inch). An air stream was blown over the donor surface to remove the ablated dye. The ablated dye and other effluents are collected by suction. The measured total power at the focal plane was 100 mW. Densitometer readings were obtained as in Example 1 with the following results:

TABLE 2

| | Yellow Dmax | Dmin @ 755 mj/cm$^2$ | Dmin @ 566 mj/cm$^2$ | Dmin @ 378 mj/cm$^2$ | Dmin @ 283 mj/cm$^2$ |
|---|---|---|---|---|---|
| Y-1 (Control) (0.22 g/m$^2$) | 1.6 | 0.17 | 0.21 | 0.27 | 0.40 |
| Curcumin (0.13 g/m$^2$) | 1.1 | 0.15 | 0.15 | 0.17 | 0.23 |

Table 2 shows that the clean-out in the visible region is comparable for the two dyes even with the lower laydown of the curcumin dye.

TABLE 3

| | UV Dmax | Dmin @ 755 mj/cm$^2$ | Dmin @ 566 mj/cm$^2$ | Dmin @ 378 mj/cm$^2$ | Dmin @ 283 mj/cm$^2$ |
|---|---|---|---|---|---|
| Y-1 (Control) (0.22 g/m$^2$) | 2.5 | 0.16 | 0.19 | 0.25 | 0.33 |
| Curcumin (0.13 g/m$^2$) | 3.0 | 0.26 | 0.27 | 0.33 | 0.45 |

Table 3 shows that curcumin provides comparable near UV protection as yellow dye Y-1, when used in combination with Liquid UV-Absorbing Dye UV-1, but at a lower laydown. Dye UV-1 was used in both cases to allow better spectral coverage of the UV spectral region. Without the use of Dye UV-1, Y-1 would have little UV absorption (see Table 1). The sample data shown in Tables 2 and 3 reflect a useful masking film where multiple dyes would be needed to effectively cover all activating wavelengths.

The thermal decomposition of curcumin to vanilla could be easily smelled when the filters were removed from the air suction nozzle which collect any effluents from the ablation process. With the suction collection system off, the smell of vanilla can be detected in less than a few seconds allowing quick identification of a problem with the adequate collection of dye ablation effluents. When the smell of vanilla is present, it is clear that other gas phase ablation products are not being collected adequately. The ability to quickly detect the presence of a small quantity of gas phase ablation products is an advantage as a safety backup for assessing the efficacy of the dye collection system and thereby minimize worker exposure to dye ablation products.

The invention has been described in detail with particular reference to preferred embodiments thereof, but it will be understood that variations and modifications can be effected within the spirit and scope of the invention.

What is claimed is:

1. A single sheet process of forming a dye ablation image having an improved Dmin in the absence of a receiving element comprising imagewise-heating by means of a laser, a dye-ablative recording element comprising a support having thereon a dye layer comprising an image dye dispersed in a polymeric binder having an infrared-absorbing material associated therewith, said laser exposure taking place through the side of the support having thereon said dye layer, said imagewise-heating causing imagewise dye ablation, and removing the ablated image dye material by means of an air stream to obtain said image in said dye-ablative recording element, wherein said dye layer comprises a yellow dye dispersed in a polymeric binder, said yellow dye comprising curcumin.

2. The process of claim 1 wherein said yellow dye is 1,7-bis(4-hydroxy-3-methoxyphenyl)-1,6 -heptadiene-3,5-dione.

3. The process of claim 1 wherein said yellow dye has the formula:

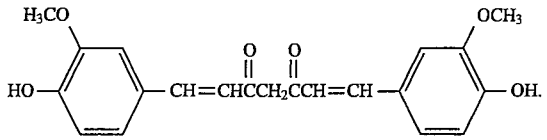

4. The process of claim 1 wherein said infrared-absorbing material is a dye which is contained in said dye layer.

* * * * *